United States Patent [19]

Kobayashi

[11] 4,352,248

[45] Oct. 5, 1982

[54] BONNET TYPE STEAMER

[75] Inventor: Takehiro Kobayashi, Sakai, Japan

[73] Assignee: Sharp Kabushiki Kaisha, Osaka, Japan

[21] Appl. No.: 157,162

[22] Filed: Jun. 6, 1980

[30] Foreign Application Priority Data

Jun. 6, 1979 [JP] Japan ..... 54-77332[U]
Aug. 31, 1979 [JP] Japan ..... 54-121304[U]
Jan. 8, 1980 [JP] Japan ..... 55-855[U]

[51] Int. Cl.[3] ..... A45D 20/44

[52] U.S. Cl. ..... 34/88; 34/99; 132/9; 219/301; 261/142; 261/DIG. 48

[58] Field of Search ..... 34/99, 100, 90, 97, 34/88; 132/9; 219/38, 301; 261/DIG. 48, 142; 239/102

[56] References Cited

U.S. PATENT DOCUMENTS 3,300,872 1/1967 Thieblot et al. ..... 34/99
3,302,301 2/1967 Goble ..... 34/99
3,645,007 2/1972 Scott ..... 34/99
3,727,322 4/1973 Walter et al. ..... 34/99
3,972,126 8/1976 De Muro et al. ..... 34/99
3,974,840 8/1976 Doyle et al. ..... 34/99
4,257,989 3/1981 Nishikawa ..... 261/DIG. 48

*Primary Examiner*—Larry I. Schwartz
*Attorney, Agent, or Firm*—Birch, Stewart, Kolasch & Birch

[57] ABSTRACT

A bonnet type steamer including an ultrasonic atomizer for generating a mist at room temperature and an electric heater for heating the mist for the generation of steam before the mist enters into the interior of a bonnet where the customer's head is inserted for hair treatment. Specifically, the steam is ejected from the entire periphery of the bonnet while running upward within the bonnet. Control circuitry made up of a microprocessor senses and regulates the temperature of the steam with the aid of a temperature sensor. The temperature of the steam and the duration of operation of the steamer are easily selectable and adjustable by the use of manual switches. A hot air generator is provided for generating hot air for drying purposes.

16 Claims, 7 Drawing Figures

BONNET TYPE STEAMER

BACKGROUND OF THE INVENTION

The invention relates to a bonnet type steamer which shortens the duration of preheating and makes the temperature of a resulting steam easily adjustable.

Prior art bonnet type steamer mainly for hair treatment in beauty salons, barbershops and homes is adapted such that feed water from a water reservoir is heated by the use of a heater within a steam generator from which steam is ejected into the interior of a bonnet via an ejection nozzle. The period of time for phase transition from liquid to vapor (i.e., preheating period) is considerably long (say, 10 minutes of preheating or standby as compared to 5 minutes of operation). Since the steam ejected into the bonnet tends to raise the interior temperature of the bonnet due to natural convection, fluctuations in the internal temperature of the bonnet produce difficulty in taking necessary measures and the steam adjacent the nozzle assumes a risky temperature of about 100° C. Another serious disadvantage of the prior art device is incapability of adjusting the vapor temperature because the steam is generated by the heating of water.

An object of the present invention is to provide a bonnet type steamer which is free of the above stated disadvantages in the prior art device.

A further object of the present invention is to provide a bonnet type steamer which shortens the period of preheating for phase transition from liquid to vapor and provides an easy and accurate adjustment of the temperature of a resulting steam.

A still further object of the present invention is to provide a bonnet type steamer which supplies not only steam but also hot air uniformly throughout the hairline area of the head of a customer.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1:
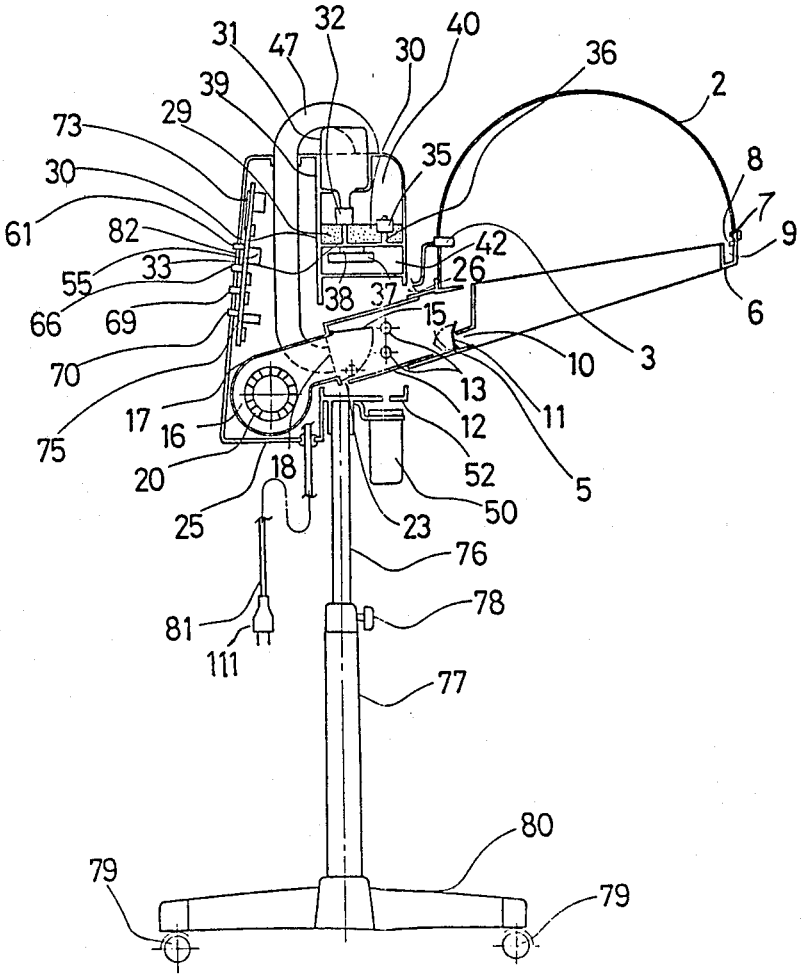
FIG. 1 is an elevational cross-sectional view of a bonnet type steamer embodying the present invention.
Figure 2:
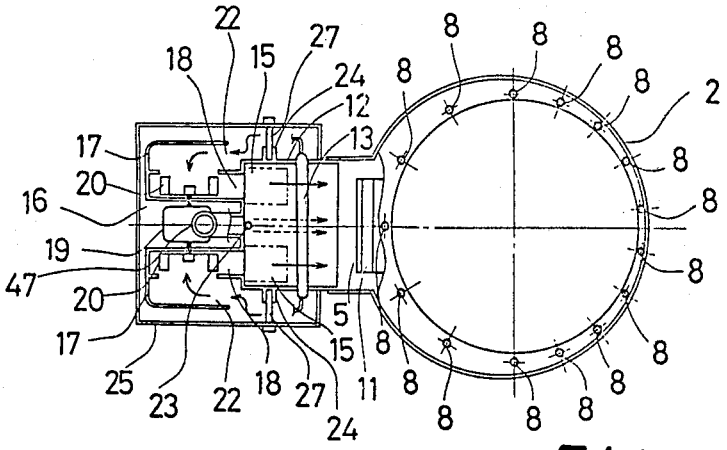
FIG. 2 is a traversal cross-sectional view of a portion of the steamer as shown in FIG. 1.
Figure 3:
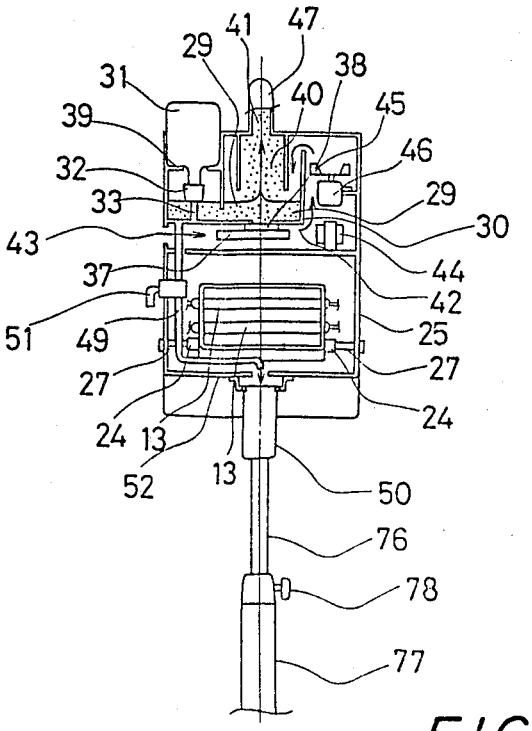
FIG. 3 is an elevational cross-sectional view of the portion of the steamer taken in a direction opposite FIG. 1.

Referring now to the drawings, there is illustrated one preferred form of a bonnet type steamer constructed in accordance with the present invention, the bonnet type steamer also having the function of a drier. A temperature sensor 3 such as a thermistor, or other conventional sensing element is provided within a bonnet 2 for monitoring the internal temperature of the bonnet 2. A bonnet ring 6 with a cylindrical supply section 5 is affixed to the periphery of the bonnet 2 by means of screws 7. The bonnet ring 6 has an ejection passageway 9 with ejection ports 8 with a spacing therebetween which decreases progressively as it becomes more remote from the supply section 5. A guide member (not shown) is secured adjacent each of the ejection ports for orienting a fluid to be ejected toward the center of the bonnet 2. A partition wall may be provided in the middle of the ejection passageway 9 in order to avoid a conflict in the fluid flow in the ejection passageway 9. A supply passageway 10 is formed directly in the supply section 5 which further carries a first shutter 11 for closing the supply passageway 10 when strongly blown air is fed to the supply section 5 (the steamer serves as a drier in the illustrated embodiment). The supply section 5 is provided with a tube-like heater box 12 which accommodates a heater 13 composed of a predetermined number (say, two) of infrared quartz tube heaters disposed normal to the direction of supply air traversing the heater box 12, with appropriate isolation from each other. There is further provided a second shutter 15 which is open when air is fed into the heater box 12. A blower unit 16 has a housing 17 divided into two segments, each having an air outlet port 18. A blower fan 20 driven by a blower motor 19 is secured within the casing 17 which also has an air inlet port 22. The heater box 12 is provided with a drain opening 23 formed therein and a pivot 24 received in an aperture 26 in a body casing 25 such that the heater box 12 is movable within a limited range and an air intake section is defined around the heater box 12. The blower unit 16 including the casing 17, the blower motor 19 and the fan 20, and the heater box 12 are accommodated within the body casing 25. The pivot 24 on the heater box 12 is movably secured in the body casing 25 such that the inclination of the bonnet 2 is easily adjustable. Over the body casing 25 there is disposed an atomizing fluid reservoir 30 containing a proper fluid (generally, pure water or utility water). On the bottom of the reservoir 30 there are disposed an opening pin 33 for opening a valve 32 to a fluid supply tank 31 from which the fluid 29 is led to the reservoir 30 and a guide pin 36 for guiding a float 35 sensing the level of the fluid 29 in the reservoir 30 and slidably secured by the guide pin 36. An ultrasonic vibrator 38 excited by an ultrasonic oscillator circuit 37 is provided on the bottom of the reservoir 30 for atomizing the fluid 29 in the reservoir 30. A mount 39 on which the supply tank 31 is detachably disposed is provided over the reservoir 30 and an atomizer chamber 40 is defined above the ultrasonic vibrator 38. An air passageway 42 having an inlet port 43 is formed in the body casing 25 for leading mist 41 generated from the atomizer chamber 30 to the exterior of the body casing by the action of an air blown. A fan motor 46 which drives a blower fan 45 for conveying air from the air passageway 42 toward the reservoir 30 is received within the body casing 25 together with a power transformer 44. The air flow created by the blower fan 45 feeds the mist 41 from the reservoir 30 to the heater box 12 through a supply hose 47 of which one end is connected to the atomizer chamber 40 and the other end is connected to the heater box 12. A drain hose 49 has two opposite ends one connected to the reservoir 30 and the other located in a drain tank 50 removably mounted on the body casing 25. A tap 51 is positioned in the drain hose 49 to adjust the amount of the mist to be discharged. A conduit 52 is formed in the drain tank 50 to collect the drain from the ejection ports 23 in the heater box 12. Within the body casing 25 there is disposed a circuit board 75 carrying a control circuit 55 controlling the operating conditions of the heater 13, the blower unit 16 and the ultrasonic atomizer (including the ultrasonic oscillator circuit 37 and the blower motor 46), a series of respective switches 56 to 71 governing the control circuit 55 and a display 73 for visually displaying the operative state of the control circuit 55. The body casing 25 is mounted movable on a slide prop 76 which in turn can be secured slidably anywhere on a second slide prop 77 by means of a fixing knob 78. The second prop 77 is fixed on a basement 80 with casters 79.

Figure 4:
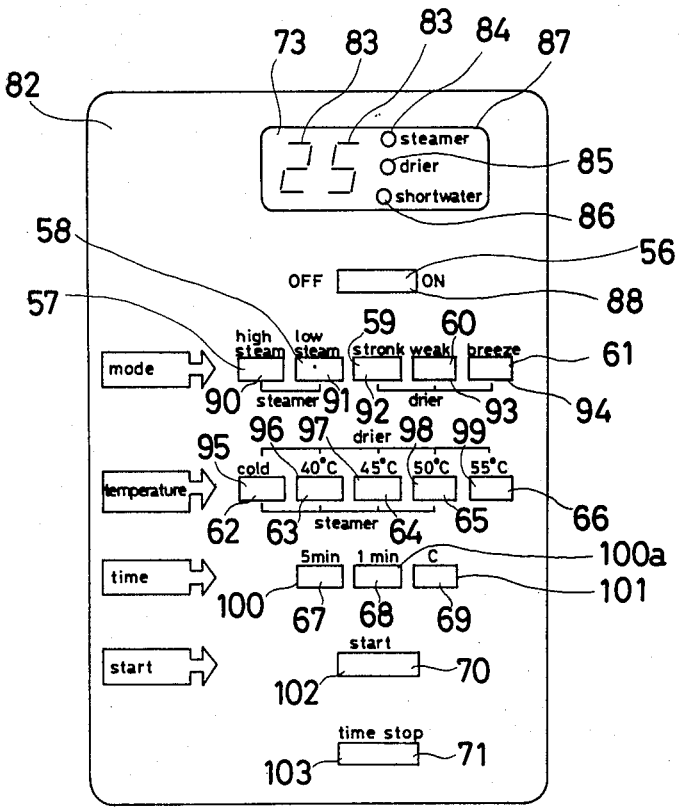
FIG. 4 is a schematic diagram of an operational panel of FIG. 1.

An electric cord 81 is connected to the steamer for power supply. There is provided on the rear of the body casing 25 a display panel 82 having a display window 87 to which a time display 73 of FIG. 4 including segmented digital display elements 83, light emitting elements 84, 85 and 86, for example, light emitting diodes each reading "steamer," "drier" and "short water;" a hole 88 through which a power switch 56 passes; holes 90 to 94 for a mode selector of the locked release structure allowing selection of one of a high stream volume switch 57, a low stream volume switch 58, a strong air drier switch 59, a weak air drier switch 60, a breeze drier switch 61; holes 95 to 99 for a temperature selector of the locked release structure allowing selection of one of a room temperature switch 62 useful for the drier or steamer mode (the heater 13 is kept from being supplied with power in order to attain room temperature, a 40° C. switch 63, a 45° C. switch 64, a 50° C. switch 65 and a 55° C. switch 67; holes 100 and 100*a* for a timer of the momentary structure (the number of actuations are accumulated) allowing one of a 5 minutes switch 67 and a 1 minute switch 68 for determining the period of the steamer or drier mode; a hole 101 for a cancel switch 69 for canceling settings in the timer; a hole 102 for a start switch 70 of the momentary structure; and a hole 103 for a stop switch 71 for discontinuing the mode of operation, all of which are in registry with the respective switches.

Figure 5:
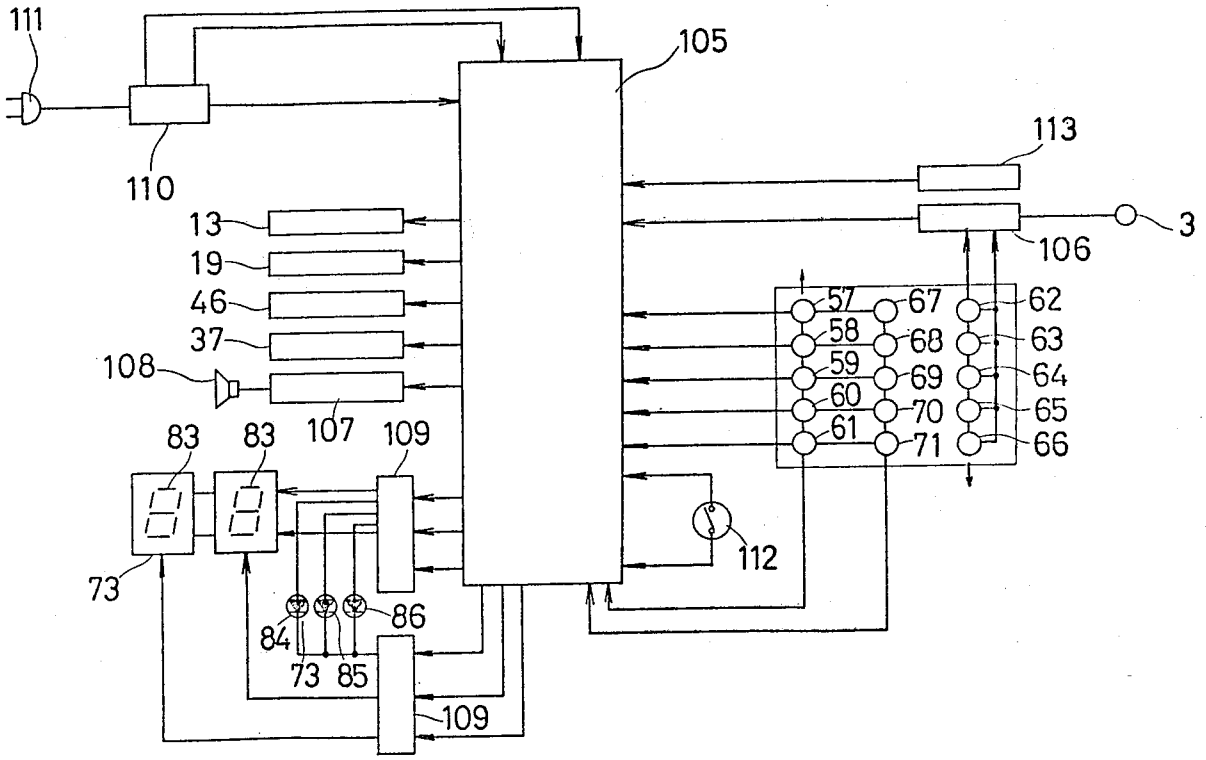
FIG. 5 is a block diagram for control circuitry of the bonnet type steamer embodying the present invention.

FIG. 5 is a schematic block diagram of control circuitry for the above stated bonnet type steamer embodying the present invention, which includes essentially a one-chip microprocessor 105 with a ROM (read only memory) operating as follows.

The microprocessor has the function of comparing an electrical indication of the internal temperature of the bonnet 2 from the temperature sensor 3 with temperature settings in the temperature switches 62 to 66 through a comparator 106 and controlling current conduction through the heater 13 (current is allowed) to conduct when the internal temperature of the bonnet 2 is in excess of the temperature settings and prohibited from conducting therethrough otherwise); the function of controlling a current flow through the ultrasonic atomizer circuit 37 in response to the output from a lever sensor attached to the float 35 (current is prevented from flowing when the level of the fluid in the reservoir 30 is below a given level and allowed when it is above the given level); the function of controlling an exciting current to a loud speaker 108 for releasing alarming sounds (the alarming sounds such as "peep" are liberated when the level of the fluid in the reservoir 30 is higher than the given one); the function of controlling current conduction through the light emitting elements 84 to 86 of the display 73 (the light emitting elements is enabled to blink when the fluid level in the reservoir 30 lowers and approaches the given level and is disabled when the former is higher than the latter); the function of controlling conduction of current to the heater 13, the blower motors 19 and 46, the ultrasonic atomizer circuit 37, a sound circuit 107 and a driver circuit 109 in response to the settings in the time switches 67 and 68 and the mode switches 57 to 61 to excite respective segments of the digital display elements 83 in the display window 73 for a visual indication of time settings and remaining times while blinking indications of the passage of time per second; the function of starting a desired mode of operation upon actuation of the start switch 70; the function of discontinuing a desired mode of operation upon actuation of the time stop switch 71; the function of releasing through the loud speaker 108 sounds representing that the temperature switches 62 to 66, the time switches 67 and 68, the mode switches 57 to 61, etc., have been properly actuated; the function of releasing alarm sounds "peep" from the loud speaker 108 via the sound circuit 107, which sounds indicate malfunction of the temperature sensor 3; the function of releasing alarm sounds "peep" when the temperature switches 62 to 66 or the mode switches 57 to 61 are unlocked during operation for any reason; and the function of releasing interrupted sounds "peep," "peep" from the loud speaker 108 via the sound circuit 107 upon the completion of operation. A power supply circuit 110 stabilizes a power supply voltage from a power plug 111 and supplies such stabilized voltage to the microprocessor 105. Specifically, the microprocessor 105 is supplied with pulses synchronous with the power frequency from the power supply circuit 110, the pulses providing clock pulses, a basis for timekeeping function, for the microprocessor 105. A frequency switch 112 is provided for accommodating for changes in power frequency between geographical zones.

The mode switches 57 to 61, the time switches 67 and 68, the start switch 70 and the stop switch 71 are matrix-wired and led to input terminals of the microprocessor 105. When one of the drier switches 59 to 61 out of the mode switches 57 to 61 is actuated, the microprocessor 105 automatically ignores the output from the level sensor 113 and disables the ultrasonic atomizer circuit 37. At the movement the fan motor 46 is energized for the blower fan 45 so that the air flow drawn by the blower fan 45 prevents the air drawn by the fan 20 from entering into the atomizer reservoir 30 via the supply hose 47 and assists the operation of the blower unit 16. On the other hand, when one of the steamer switches 57 and 58 out of the mode switches 57 to 61 is depressed, the microprocessor 105 renders the ultrasonic atomizer circuit 37 operative and discontinues operation of the blower motor 19 in the blower unit 16 and the output of the ultrasonic atomizer circuit 37 is set at a high level or a low level in response to the operative state of the steamer volume switches. If the reservoir 30 is replenished and the level of the fluid restores its normal level, then alarm sounds as to the level of the fluid 29 are cleared.

The bonnet type steamer apparatus embodying the present invention as discussed above will operate in the following manner.

When the apparatus is desired to operate as a steamer, the supply tank 31 is filled with a measured amount of the fluid to be atomized and the power plug 111 is inserted into a utility power source and the power switch 56 on the operational panel 82 is flipped on. Either the high steam volume switch 57 or the low steam volume switch 58 is selected. Under the circumstances the light emitting element 84 reading "steam" out of the display 73 is energized. Then, upon selection of the temperature switches 62 to 66 the temperature is selected at any one of room temperature, 40° C., 45° C. or 50° C. For example, when 28 minutes of the steamer operation are desirable, the 5 minutes switch 67 is actuated five times and the 1 minute switch 68 is actuated thrice. However, provided that 55° C. (available only during drier mode) is inadvertently selected, alarm sounds "peep" are delivered. The time settings in the time switches 67 and 68 are visually displayed in the display window 87 by the function of the digital display elements 83.

The bonnet 2 is positioned to encircle the hairline area of the customer's head and the start switch 70 on the operational panel 82 is actuated. The microprocessor 105 sets up the steamer mode. In other words, the heater 13, the fan motor 46 and the ultrasonic atomizer circuit 37 are turned on at a time. The digital display elements 83 in the display window 84 provides a visual indication of a remaining period of time minutely while providing a blinking indication of the passage of time per second. By the air drawn by the blower fan 45 the room temperature mist 41 is conveyed from the reservoir 30 to the heater box 12 via the supply hose 47 and thereafter heated up to steam by means of the heater 13 in the heater box 12. The resulting steam is fed into the interior of the bonnet 2 through the ejection ports 8 and the supply passageway 10. When the internal temperature of the bonnet 12 reaches a preset value, the microprocessor 105 stops conducting current to the heater 13 and keeps the internal atmosphere of the bonnet 2 at a constant temperature.

Figure 6:
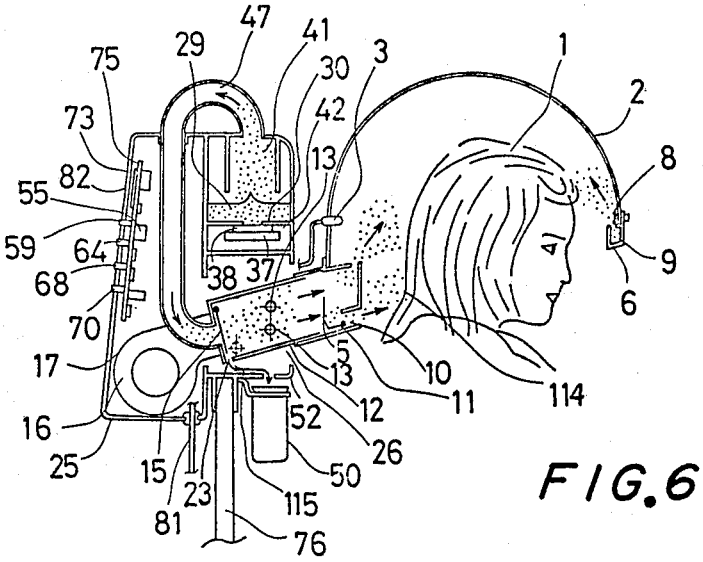
FIG. 6 is an elevational cross-sectional view of the steamer when the bonnet type steamer is used as a steamer.
Figure 7:
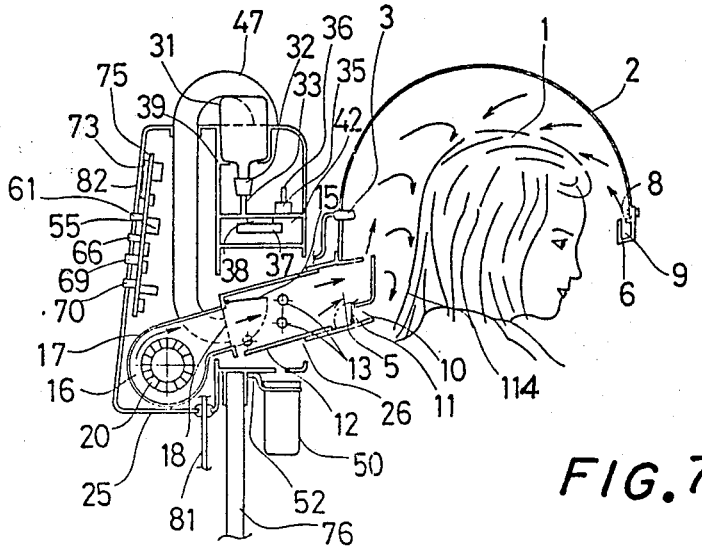
FIG. 7 is an elevational cross-sectional view when the bonnet type steamer is used as a drier.

While in the steamer mode, the fan 20 in the blower unit 16 is disabled and the second shutter 15 is in the close position keeping the steam heated within the heater box 12 from entering into the blower unit 16. When this occurs, the first shutter 11 is open so that a portion of the heated steam in the heater box is sent to the interior of the bonnet 2 from the supply passageway 10 which is in face-to-face relationship with a nape region 114 of the hairline area 1 of the customer's head, easing the difficulty in effecting hair treatment at harder hair at the nape region than the other regions. Moving upward from the ejection ports 8 at the periphery of the bonnet 2, the remaining portion of the steam is distributed uniformly over the hairline region 1. The drain (water) from the interior of the heater box 12 is collected at the drain tank 50 via a passageway 115 as depicted by the solid line in FIG. 6.

After the completion of the steam mode, the microprocessor 105 cuts off the control signals. In this case the digital display elements 83 in the window 87 show zero at a moment and shortly after show the original time settings. This offers beautician's convenience in recording entries on customers' cards in or after hair treatment.

When the apparatus behaves as a drier, either the strong wind switch 59, the weak wind switch 60 or the breeze switch 61 is actuated so that the light emitting element 85 reading "drier" is energized to indicate that the apparatus operates in the drier mode. One of the above specified temperatures, room temperature, 40° C., 45° C., 50° C. and 55° C. is selected upon actuation of one of the temperature setting switches 62 to 66 and a desired period of time is set by means of the time switches 67 and 68, this setting being visually displayed on the digital display elements 83 in the window 87.

Thereafter, the hairline area 1 of the customer's head is inserted into the bonnet 2 and the start switch 70 on the operational panel 82 is depressed. The microprocessor 105 initiates the drier mode. Simultaneously, the heater 13 and the blower motor 19 and the fan motor 46 in the blower unit 16 are energized. The digital display elements 83 provide a visual display of the elapsed time minutely while blinking per second. The air drawn by the blower fan 19 in the blower unit 16 is guided to the heater box 12 and heated by the heater 13 in the heater box 12, forming a hot air which is to be fed into the bonnet 2 via the ejection ports 8 in the bonnet ring 6. When the internal temperature of the bonnet 2 reaches a predetermined temperature, the microprocessor 105 ceases supplying conduction current to the heater 13. The heater 13 is thereafter energized in such an interrupted manner as to keep the temperature of the bonnet 2 constant.

During the drier mode the air flow drawn by the blower fan 19 is greatly wilder than that by the blower fan 45 so that the supply passageway 10 is shut off by the first shutter 11 to prevent the hot air from centering on the nape region 114 of the customer's head, generating disagreeable heat and lowering the thermal efficiency of the drier. Since the hot air goes upward from the ejection ports 8 at the periphery of the bonnet 2 and moves out of the bonnet 2 after running through complicated routes along the hair at the hairline area 1 of the customer's head, the length of time where the hot air retains within the bonnet 2 and contacts the hair becomes longer, with an attendant increase in drying efficiency. To this end the same drying efficiency as does the conventional drier is available with a one-half of the amount of air. Due to a decreased amount of air and complicated air flows it is possible to dry the hair without disturbing the hair at the hairline area 1. Because the amount of air may be reduced or because there are the two fans 20 in the blower unit 16, it also becomes possible to eliminate operating noise harsh to the customer being serviced, other customers waiting in beauty salons, even to the beautician.

It should be noted that thermal efficiency is excellent because the air from the inlet port 22 of the blower unit 16 is confined at the periphery of the heater box 12 or adjacent a back lower portion of the bonnet 2 and preheated during the course of drawing the surrounding air thereinto. While the blower fan 45 is operating, the air drawn by the fan 19 is prohibited from entering the atomizer reservoir 30 via the supply hose 47.

The benefits obtained by the bonnet type steamer embodying present invention may be as follows: When in the steamer mode the ultrasonic atomizer and the electric heater start operating and attaining a desired or preset temperature immediately to avoid the need to preheat those devices. The use of the room temperature mist makes it possible to control accurately the temperature of the resulting steam without any overheated or risky condition. An improved steaming effect is assured because of the steam being uniformly distributed from the entire periphery of the bonnet. In addition, during the drier mode the hot air may be supplied from the entire periphery of the bonnet with attendant features: a decreased amount of air, no disturbance of the hair at the hairline area of the customer's head and reduction of noise.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A bonnet type steamer comprising:
a bonnet having a fluid passageway;
an atomizer means for generating a mist at room temperature;
means for supplying the mist from said atomizer means to said bonnet through said fluid passageway and
heater means provided in said fluid passageway for heating said mist from said atomizing means to generate steam.

2. The bonnet type steamer as set forth in claim 1 wherein said fluid passageway is formed at the periphery of said bonnet so that the resulting steam is ejected from the periphery of said bonnet.

3. The bonnet type steamer as set forth in claim 2 wherein said steam is moved upward from said periphery of said bonnet.

4. The bonnet type steamer as set forth in claim 1 wherein said atomizer means is of the ultrasonic type which uses an ultrasonic vibrator and a reservoir for receiving a fluid to be atomized into said mist.

5. A bonnet type steamer comprising:
a bonnet having a fluid passageway;
an atomizer means for generating a mist at room temperature;
means for supplying the mist from said atomizer means to said bonnet through said fluid passageway and
heater means provided in said fluid passageway for heating said mist from said atomizing means to steam; and
a hot air generator means for generating hot air and means for supplying the hot air to said fluid passageway, wherein said steamer serves not only as a steamer by the use of said atomizer means but also as a drier by the use of said hot air generator means.

6. The bonnet type steamer as set forth in claim 5 wherein said hot air generator means comprises an air blower means for drawing air, said drawn air being heated by said heater means.

7. The bonnet type steamer as set forth in claim 5 wherein said atomizer means is disabled when said steamer is desired to serve as a steamer.

8. The bonnet type steamer as set forth in claim 5, further comprising a first shutter means for preventing said hot air from moving into the interior of said bonnet when said steamer is functioning as the steamer.

9. The bonnet type steamer as set forth in claim 8 further comprising a second shutter means for preventing said hot air from entering into said atomizer means.

10. The bonnet type steamer as set forth in claim 5 further comprising a mode display means for displaying the operative mode of said steamer.

11. A bonnet type steamer comprising:
a bonnet having a fluid passageway;
an atomizer means for generating a mist at room temperature;
means for supplying said mist from said atomizer means to said bonnet through said fluid passageway;
a heater means provided in said fluid passageway for heating said mist from said atomizing means to generate steam;
switch means for presetting the temperature of said resulting steam;
a sensor means for sensing the temperature of said steam being generated; and
a control circuit means for equalizing the temperature of said resulting steam to said preset temperature in response to the output of said sensor means.

12. The bonnet type steamer as set forth in claim 11 wherein said control circuit means comprises a microprocessor.

13. The bonnet type steamer as set forth in claim 11 further comprising a timer means for determining the duration of operation of said bonnet type steamer.

14. The bonnet type steamer as set forth in claim 13 further comprising a remaining time display means for displaying the remaining time in said switch means.

15. A bonnet type hair treatment apparatus comprising:
a bonnet having a fluid passageway and adapted to receive the user's head;
an atomizer means for generating a mist at room temperature
means for supplying the mist from said atomizer means to said bonnet through said fluid passageway and
heater means provided in said fluid passageway for heating said mist from said atomizing means to generate steam, wherein said resulting steam is used in treating the hair at the hairline area of the user's head.

16. A bonnet type steamer comprising:
a bonnet having a fluid passageway;
an atomizer means for generating a mist at room temperature, wherein said atomizer means is of the ultrasonic type which uses an ultrasonic vibrator and a reservoir for receiving a fluid to be atomized into said mist;
means for supplying said mist from said atomizer means to said bonnet through said fluid passageway;
heater means provided in said passageway for heating said mist from said atomizing means to generate steam;
a hot air generator means for generating hot air with means for supplying said hot air to said fluid passageway; and
two fans, one of said fans being operatively associated with said atomizer means and the other of said fans being operatively associated with said hot air generator means with the capacity of the former being less than the capacity of the latter, wherein said steamer serves both as a steamer in the use of said atomizer but also as a dryer in the use of said hot air generator means.

* * * * *